US005353923A

United States Patent [19]

Skeels

[11] Patent Number: 5,353,923

[45] Date of Patent: Oct. 11, 1994

[54] SOAP HANGER DEVICE

[76] Inventor: Roger E. Skeels, 356 Fells Rd., Essex Fells, N.J. 07021

[21] Appl. No.: 183,490

[22] Filed: Jan. 19, 1994

[51] Int. Cl.[5] ..... A47K 5/08

[52] U.S. Cl. ..... 206/77.1; 248/316.5

[58] Field of Search ..... 206/77.1, 581, 823; 248/682, 316.1, 316.5

[56] References Cited

U.S. PATENT DOCUMENTS

| | | | |
|---|---|---|---|
| 2,036,204 | 4/1936 | Eassle | 206/77.1 |
| 2,172,862 | 9/1939 | Brookshier | 206/77.1 |
| 2,409,827 | 10/1946 | Blankner | 206/77.1 |
| 3,106,798 | 10/1963 | Barish | 206/77.1 |
| 4,313,537 | 2/1982 | Collet | 206/77.1 |
| 5,167,392 | 12/1992 | Henricksen | 248/316.5 X |

*Primary Examiner*—Jacob K. Ackun, Jr.
*Attorney, Agent, or Firm*—Lerner, David, Littenberg, Krumholz & Mentlik

[57] ABSTRACT

A soap holder for retaining soap in a relatively dry manner is disclosed. The soap holder has a housing and a plurality of coacting arms rotatably connected to the housing. A phase control device, such as sector gears, are mounted at the interior of the housing for synchronizing the rotatable movement of the plurality of coacting arms. The coacting arms are normally in a first position at which they are biased to a nonengaged configuration and are adapted for synchronized movement to a second position at which they are biased to an engaged configuration upon insertion of a bar of soap therebetween.

29 Claims, 3 Drawing Sheets

FIG. 2
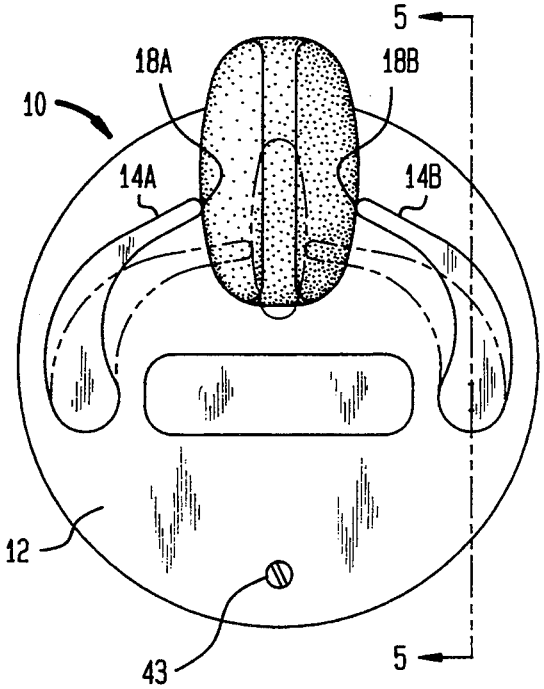
FIG. 5
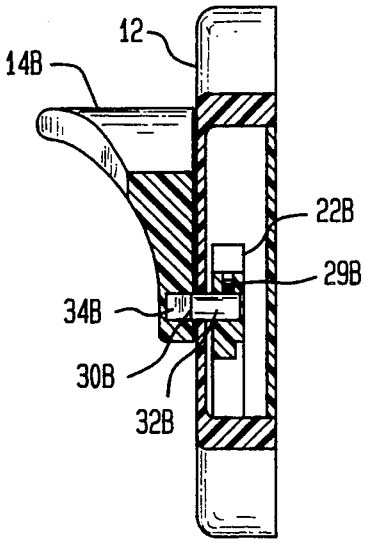
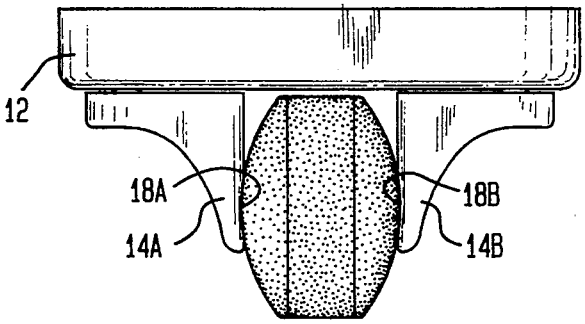
FIG. 3
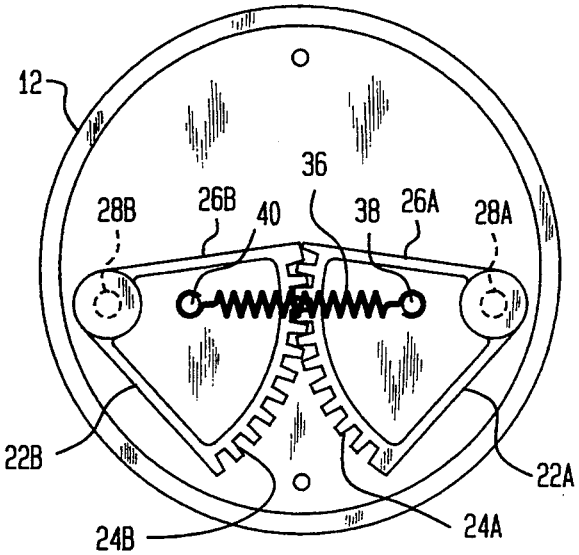
FIG. 4

SOAP HANGER DEVICE

FIELD OF THE INVENTION

The present invention relates to soap holding devices. More particularly, the present invention relates to a device for retaining a bar of soap or the like between at least two coacting arms so that the soap may be held at a convenient location free from pools of water thus preventing the soap from becoming soft due to continuous dissolution which normally takes place in such pools of water.

BACKGROUND OF THE INVENTION

Soap dishes and the like have been widely used in the prior art to retain a bar of soap while a person is bathing or cleaning at a sink or basin. Most soap dishes are undesirable because they retain water which forms pools in which an associated bar of soap is placed when the soap is returned to the dish. This substantially decreases the life span of the associated bar of soap as the soap continuously dissolves in the pools of water and thus, becomes softened. The next time the bar of soap is used, the softened portions of the associated bar of soap quickly wash away. Softened soap is also undesirable as it is messy to use and usually does not permit the soap to properly lather during use.

Prior art inventors have expended great amounts of effort in attempting to solve the foregoing problem. Thus, the prior art is replete with devices which attempt to retain a bar of soap in a relatively dry environment. In this regard, soap dishes including drain holes have been proposed. However, the use of these devices are limited to selected environments. Additionally, soap dishes of any type are undesirable as they take up valuable counter space.

Other soap retention devices which utilize pivotal members have been proposed to retain soap in a relatively dry environment, i.e., free from pools of water. Such devices are disclosed in U.S. Pat. Nos. 2,036,204 to Enssle; 4,313,537 to Collet; and 4,435,030 to Haven.

However, these devices also have drawbacks. In this regard, the structure and operation of the devices disclosed in the foregoing patents are problematic in various respects. The present invention solves all of the aforementioned problems by providing a new soap holder including means for retaining soap between a plurality of coacting arms in a convenient and effective manner so that valuable counter space can be saved while prolonging the life span of an associated bar of soap.

SUMMARY AND OBJECTS OF THE INVENTION

One aspect of the present invention pertains to a soap holder for retaining soap in a convenient and dry manner. The soap holder comprises a housing having an interior and an exterior. A plurality of coacting arms are rotatably connected to the housing and are disposed for synchronized movement with each other from a first position at which the plurality of coacting arms are normally biased to a nonengaged configuration and a second position at which the plurality of coacting arms are biased to an engaged configuration upon insertion of a bar of soap therebetween. Phase control means are operatively connected to the plurality of coacting arms and are mounted at the interior of the housing for synchronizing rotatable movement of the plurality of coacting arms.

In a preferred embodiment, the housing of the soap holder includes a plurality of bearings fixed at a predetermined spaced distance from each other. It is also preferable for a plurality of shafts to be rotatably mounted within corresponding ones of the plurality of bearings, and extending from the interior to the exterior of the housing. In this preferred embodiment, the plurality of coacting arms may be mounted on associated ones of the plurality of shafts for rotatable movement therewith.

In another preferred embodiment, the soap holder may comprise biasing means operatively connected to the phase control means for exerting a biasing force thereon so that the plurality of coacting arms are constantly biased toward the first position.

The soap holder may also comprise connecting means for securing the soap holder to a support surface.

In another preferred embodiment, the soap holder may comprise a support surface adapted to be mounted on a wall and the housing may be secured to the support surface. Optionally, the housing may be releasably secured to the support surface.

In another preferred embodiment, the phase control means may comprise a pair of sector gears having teeth thereon and being operatively associated with each other so that the teeth of each of the sector gears mesh during relative rotatable movement thereof to assure that the pair of sector gears, and thus the coacting arms, obtain synchronous rotation.

In still another preferred embodiment, the plurality of shafts may comprise a pair of shafts, and the plurality of bearings may comprise a pair of bearings spaced from each other within the housing. Each one of the pair of bearings are preferably disposed to receive respective ones of the pair of shafts therein. The bearings may have circular cross sections to facilitate rotatable movement of respective ones of the shafts therein.

In still another preferred embodiment of the present invention, the plurality of coacting arms may comprise a pair of coacting arms. Each of the coacting arms may include a first end mounted on corresponding ones of the pair of shafts, and a second end remote from the first end wherein the second ends are adapted to cooperate so that a bar of soap may be retained therebetween when the pair of arms are arranged in the second position and have thus assumed their engaged configuration.

It is preferable for the biasing means of the present invention to comprise at least one spring connected between the phase control means for movement from a first expanded position at which the plurality of coacting arms assume a nonengaged configuration to a further expanded position at which the plurality of coacting arms assume an engaged configuration upon insertion of a bar of soap therebetween.

In yet another preferred embodiment, the pair of coacting arms may comprise a sized and shaped sleeve adapted to be mounted on respective ones of the pair of shafts.

Each of the shafts may comprise a first section having a circular cross-section adjacent the first end thereof and extending linearly therealong toward the second end thereof, and a second section having a substantially square cross-section adjacent the second end and extending linearly therealong toward said first end thereof. The diameter of the first section is preferably greater than the diameter of the second section and is disposed within the interior of associated ones of the pair of bearings. The second section may be disposed within the sized and shaped sleeves of respective ones of the pair of shafts.

Each of the sector gears may include a sized and shaped bore therein. Such bores being adapted to receive the circular first section of corresponding ones of the first and second shafts. The soap holder may also comprise a pair of set screws adapted to retain the first and second shafts within the respective bores of the first and second sector gears.

In still another preferred embodiment, the soap holder may comprise locking means arranged at the second end of the first and second shafts for locking respective ones of the first and second coacting arms to said second end of the first and second shafts. The sized and shaped sleeves of the pair of coacting arms may include a square cross-section. In this embodiment, the locking means may comprise the combination of the assembled arrangement between the substantially square second section of the first and second shafts in respective ones of the sleeves of the first and second coacting arms.

Accordingly, it is an object of the present invention to provide a soap holder including a plurality of coacting arms operatively associated with phase control means for holding a bar of soap therebetween in a convenient and relatively dry location.

It is another object of the present invention to provide a soap holder which can be mounted to a wall or other support structure so that counter space can be saved.

It is another object of the present invention to provide a soap holder which is adapted to retain a bar of soap between a plurality of coacting arms free from pools of water so that the life span of the soap can be increased.

These and other objects, features and advantages of the present invention will be more fully understood with reference to the following detailed description of the soap holder of the present invention when taken in conjunction with the accompanying drawings which follow.

BRIEF DESCRIPTION OF THE DRAWINGS

FIG. 2 is a front elevational view of the soap holder shown in FIG. 1.

FIG. 3 is a top plan view of the soap holder shown in FIG. 1 in assembled position on a wall.

FIG. 4 is a rear view of the soap holder shown in FIG. 1 with the wall plate removed.

FIG. 5 is a side cross sectional view of the soap holder of the present invention taken along line 5—5 of FIG. 2.

DETAILED DESCRIPTION OF THE PREFERRED EMBODIMENTS

Figure 1:
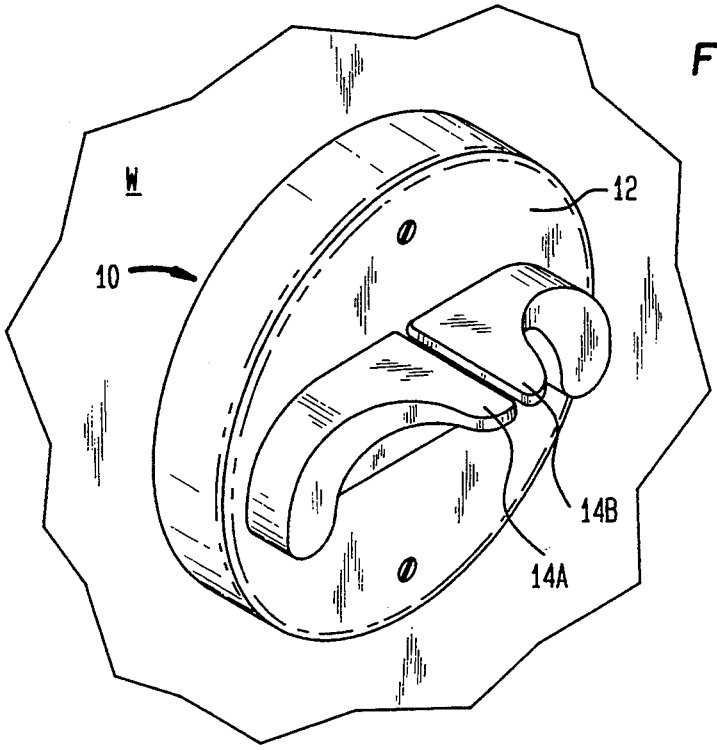
FIG. 1 is a perspective view of a soap holder in accordance with the present invention.

In accordance with one preferred embodiment of the present invention, the soap holder 10 is shown in FIGS. 1–6. The soap holder 10 includes a housing 12 and may be mounted on a wall W as shown in FIG. 1. The housing 12 is preferably made of plastic material, although other suitable material such as ceramic and the like may be used.

The soap holder 10 also includes a pair of coacting arms 14A and 14B. Each of the coacting arms 14A and 14B are identical to each other and thus, the following description of coacting arm 14A applies equally to coacting arm 14B except that the reference numerals are designated "B" as opposed to "A" as can be appreciated from FIGS. 1–6.

As best shown in FIGS. 1, 2, 3 and 6, coacting arm 14A includes a first end 16A which defines a sleeve 20A having a passageway therein to permit mounting of the first coacting arm 14A on an external surface of a corresponding shaft as will be discussed in more detail below. The coacting arm 14A includes a second end 18A spaced from the first end 16A as shown in FIGS. 1 and 4. The length of the coacting arms 14A and 14B is preferably between about 2.125–2.375 inches. However, it should be understood that in alternate embodiments, the length of the coacting arms may vary outside of the preferred range. The coacting arms 14A and 14B may have a predetermined width of between about 2.0–2.125 inches. Again, it should be understood that the dimensions of the coacting arms may vary in alternate embodiments outside of those recited herein.

In the embodiment of the present invention shown in FIGS. 1–6, the housing 12 includes a pair of spaced bearings 21A and 21B. As best shown in FIG. 5, the bearings are fixed to the housing 12 and are preferably integral therewith. Although the dimensions and cross sectional configuration of the bearings 21A and 21B may vary within the scope of the present invention, it is preferable for the bearings 21A and 21B to have a circular cross section to facilitate rotation of a shaft therein as will be discussed further below. Optionally, a pair of bushings 23A and 23B may be mounted within respective ones of the bearings 21A and 21B. The bearings 21A and 21B include an internal surface for supporting respective ones of the bushings 23A and 23B or respective shaft members therein.

Figure 6:
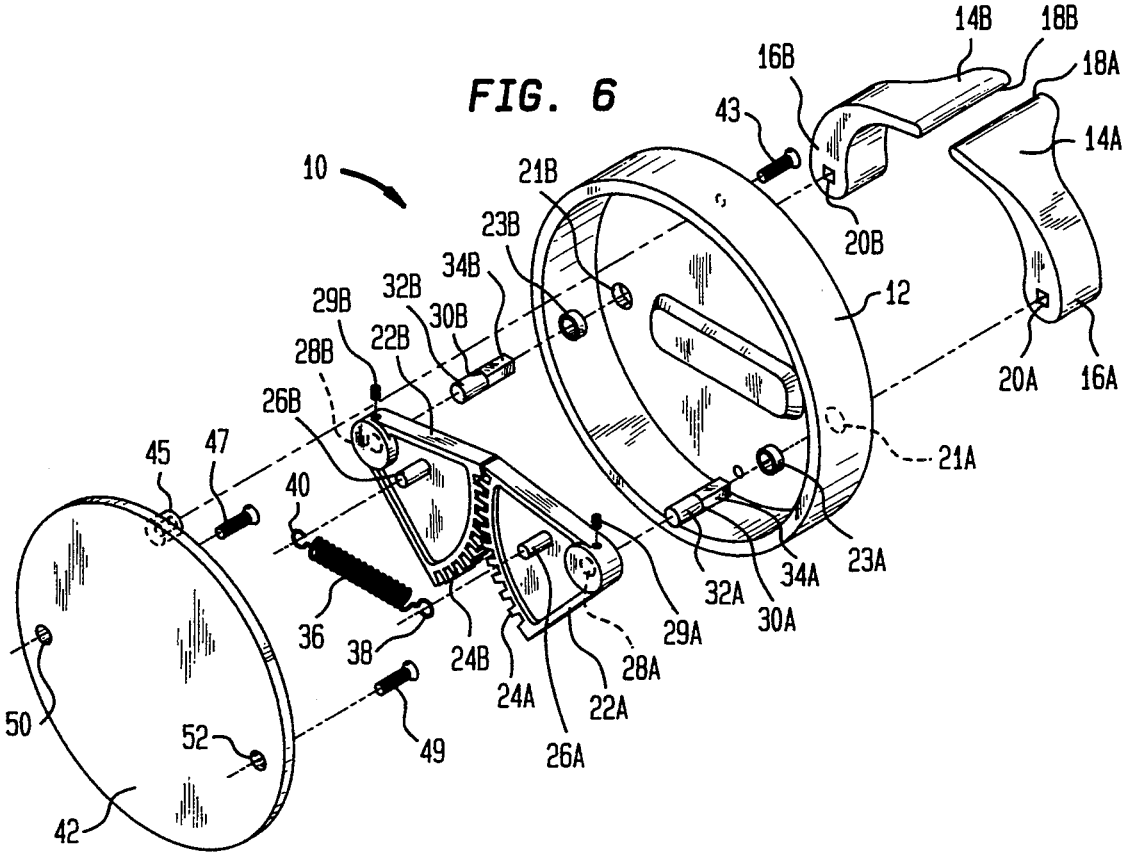
FIG. 6 is a perspective exploded view showing the elements of the soap holder of FIG. 1.

As illustrated in FIGS. 5 and 6, the passageway through the sleeve 20A of the first coacting arm 14A has a substantially square cross-section which is adapted to receive a similarly shaped section of a shaft therein. This feature of the present invention will be further described below.

The soap holder 10 also includes a pair of sector gears 22A and 22B which function as phase control means and are adapted to be mounted within the housing 12 as shown in FIGS. 4, 5 and 6. Additionally, as discussed briefly above, the soap holder 10 includes a pair of shafts 30A and 30B which are adapted to be connected to corresponding ones of the sector gears 22A and 22B. It should be understood that in the preferred embodiment of FIGS. 1–6, sector gears 22A and 22B are identical, as are shafts 30A and 30B. Thus, any reference herein to the structure and operation of either of the sector gears 22A and 22B or shafts 30A and 30B, will apply equally to the corresponding component.

As best shown in FIGS. 4 and 5, the sector gears 22A and 22B include a plurality of teeth 24A and 24B arranged on an arcuate outer surface thereof. The sector gears 22A and 22B also include corresponding mounting pins 26A and 26B on which a spring 36 may be mounted. More particularly, the spring 36 includes a first end 38 which is adapted to be connected to mounting pin 26A. Spring 36 also includes a second end 40 which is adapted to be connected to mounting pin 26B.

Each of the sector gears 24A and 24B also include a sized bore 28A and 28B in which corresponding shafts 30A and 30B are secured thereto in a manner more fully described below. As shown in FIGS. 5 and 6, the shafts 30A and 30B are separable components of the soap holder 10. However, the shafts 30A and 30B are adapted to be fixed to corresponding ones of the sector gears 22A and 22B within respective bores 28A and 28B by set screws 29A and 29B for simultaneous rotatable movement therewith. In alternate embodiments, the shafts 30A and 30B may be integral with respective ones of the sector gears 22A and 22B. However, in all embodiments, it is an important feature of the present invention for the shafts 30A and 30B to simultaneously rotate with corresponding ones of the sector gears 22A and 22B.

As shown in FIGS. 5 and 6, the shaft 30A includes a circular cross sectional area 32A and a substantially square cross sectional area 34A. When the sector gear 22A is mounted within the housing 12, the circular cross sectional area 32A of the shaft 30A will extend through the bushing 23A within the bearing 21A, and into bore 28A where it will be fixed by set screw 29A. At the same time, the substantially square cross sectional area 34A will extend within a corresponding shaped passageway of the sleeve 20A of the first coacting arm 14A. Preferably, the square cross sectional area 34A will be substantially secured within the similarly shaped sleeve 20A by conventional means such as a friction-fit, epoxy, or other mounting means.

As shown in FIG. 6, the soap holder 10 may include a support plate 42 which is adapted to be secured to a wall W. In this preferred embodiment, the housing 12 will preferably be removably secured to the support plate 42 by means of a cooperating screw 43 and threaded projection 45. However, in alternate embodiments, the housing 12 may have a friction fit relationship to the support plate 42 or it may be integral therewith. The support plate 42 may be mounted to a wall W by conventional means such as screws 47 and 49, which are arranged to extend through mounting holes 50 and 52, respectively. Alternatively, mounting of the support plate 42 may be achieved by adhesive, mounting brackets, and the like.

Thus, when the soap holder 10 is in assembled position, it will be mounted on a wall W, such as wall within a bathing area. In operation, the coacting arms 14A and 14B are adapted to cooperate so that a bar of soap S can be removably and securely held in a convenient location. As best shown in FIG. 1, the coacting arms 14A and 14B of the soap holder 10 are normally biased to a nonengaged position when no soap is placed therebetween. The coacting arms 14A and 14B are constantly biased into this nonengaged position by the spring 36 which exerts a biasing force on the sector gears 22A and 22B, which are urged to rotate downwardly and which therefore cause respective ones of the shafts 30A and 30B to rotate downwardly. The coacting arms 14A and 14B are fixed to corresponding sections 34A and 34B of the shafts 30A and 30B for rotation therewith. Fixing of the coacting arms 14A and 14B to the shafts may be accomplished by the corresponding relationship between the square cross sectional areas 34A and 34B on the shafts 30A and 30B and the similarly sized and shaped square cross sectional areas within the sleeves 20A and 20B of the coacting arms 14A and 14B.

Figure 7:
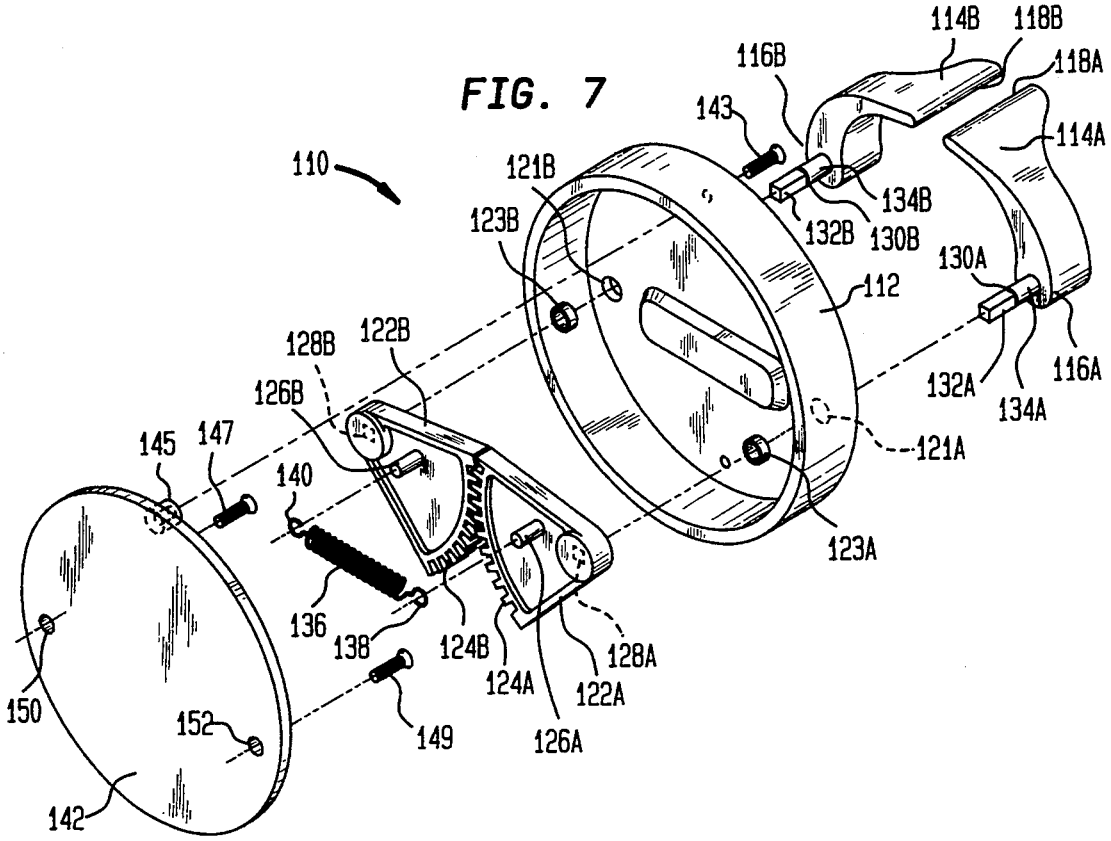
FIG. 7 is a perspective exploded view of another preferred embodiment of the present invention.

The soap holder of the present invention is shown in FIG. 7 in accordance with another preferred embodiment. Many of the components of this embodiment of the present invention are identical to the components shown in the embodiment of FIGS. 1–6. In this regard, the reference numerals of like components shown in the embodiment of FIG. 7 will be prefixed with a "1". It should also be understood that although there are some structural differences between the soap holder 110 of the embodiment of FIG. 7 and the soap holder 10 of the embodiment shown in FIGS. 1–6, the operation of the soap holders of the various embodiments is identical in that phase control means, i.e., sector gears, are used to synchronize rotatable movement of coacting arms which may retain a bar of soap therebetween.

With this in mind, one difference between the embodiments of the soap holder 10, shown in FIGS. 1–6, and the soap holder 110, shown in FIG. 7, is that the coacting arms 114A and 114B and the respective shafts 130A and 130B are integral components. More particularly, shaft 130A is integrally connected to coacting arm 114A at the first end 116A thereof. Similarly, shaft 130B is integrally connected to coacting arm 114B at the first end 116B thereof. Thus, there is no need for the shafts 130A and 130B to have a square cross sectional area at the connection site at ends 116A and 116B of coacting arms 114A and 114B, respectively.

Notwithstanding the integral nature of the shafts 130A and 130B with respective ones of the coacting arms 114A and 114B, the remote end of the shafts from the coacting arms are adapted to be fixed within bores 128A and 128B of respective ones of the sector gears 122A and 122B. In this regard, remote ends 132A and 132B of the shafts 130A and 130B may have a square cross sectional area as shown in FIG. 7. Bores 128A and 128B also have a substantially square cross sectional area, which may have a friction fit with the square cross sectional areas 132A and 132B of the shafts 130A and 130B, respectively. Thus, there is no need to use set screws to retain the shafts 130A and 130B within respective bores 128A and 128B of the sector gears. Moreover, if desired, the shafts 130A and 130B may be further secured within bores 128A and 128B by use of a push nut, a push pin, epoxy, set screws, or other suitable securing means.

Since the operation during use of the various embodiments of the soap holder of the present invention is identical from a practical standpoint, the operation thereof will be described with regard to the embodiment shown in FIGS. 1–6. However, it should be understood that such description applies equally to the soap holder shown in FIG. 7.

When a user desires to place a bar of soap into assembled position within the soap holder 10, the soap S should be pushed upwardly against the coacting arms 14A and 14B. This will cause the coacting arms 14A and 14B to rotate upwardly until the soap S is gripped by the coacting arms. At this time, the holding ends 18A and 18B of the coacting arms 14A and 14B will be in engagement with a bar of soap S as shown in FIGS. 2 and 4.

Movement of the coacting arms 14A and 14B are synchronized, i.e., kept in phase, by means of the sector gears 22A and 22B. More particularly, the teeth 24A and 24B on the respective sector gears are adapted to mesh with each other upon rotatable movement of the sector gears 22A and 22B. This will assure that rotation of corresponding shafts 30A and 30B will be synchronized and thus, rotatable movement of coacting arms 14A and 14B will be in phase at all times.

The spring 36 is preferably arranged in a slightly expanded state when the coacting arms 14A and 14B are in the nonengaged position, i.e., the downward most position. As the arms 14A and 14B are rotated upwardly upon insertion of a bar of soap therebetween, the spring 36 comes increasingly expanded so as to constantly bias the arms 14A and 14B back toward their nonengaged position.

As shown in FIG. 2, the soap holder 10 can be used to retain various sized bars of soap as the soap S shrinks. This can best be appreciated with respect to the phantom illustration of the coacting arms 14A and 14B which are adapted to rotate downwardly as the bar of soap S shrinks from its initial size to a smaller size. This is possible due to the constant downward biasing effect caused by the spring 36 and the in-phase movement of the coacting arms 14A and 14B controlled by the meshed relationship of the sector gears 22A and 22B.

To release a bar of soap S from its retained position within the soap holder 10, the soap S can simply be lifted upwardly out of the coacting arms 14A and 14B, which are designed to rotate upwardly upon exertion of a force sufficient to overcome the downward force exerted by the biasing spring 36. To assure that the soap is firmly secured between the second ends 18A and 18B of the coacting arms 14A and 14B when the arms are in their engaged position, the second ends 18A and 18B may have a serrated edge that is designed to firmly grip the bar of soap S placed therebetween.

Use of the soap holder 10 of the present invention will assure a user that soap will always be contained in a convenient location free from pools of water. Thus, the soap will not become softened, as it does in typical soap dishes when it sits in pools of water. Accordingly, use of the present invention will substantially increase the life span of an associated bar of soap as well as create a more convenient soap holder.

While the foregoing description and figures are directed toward the preferred embodiment in accordance with the present invention, it should be appreciated that numerous modifications can be made to each of the components of the soap holder 10 as discussed above. Indeed, such modifications are encouraged to be in the materials, structure and arrangement of the disclosed embodiments of the present invention without departing from the spirit and scope of the same. Thus, the foregoing description of the preferred embodiments should be taken by way of illustration rather than by way of limitation, as the present invention is defined by the claims set forth below.

What is claimed is:

1. A soap holder comprising:

a housing having an interior and an exterior;

a plurality of coacting arms rotatably connected to said housing and being disposed for synchronous movement with each other from a first position at which said plurality of coacting arms are normally biased to a nonengaged configuration and a second position at which said plurality of coacting arms are biased to an engaged configuration upon insertion of a bar of soap therebetween; and phase control means operatively connected to said plurality of coacting arms and being rotatably mounted at said interior of said housing for synchronizing rotatable movement of said plurality of coacting arms.

2. The soap holder of claim 1 further comprising biasing means operatively connected to said phase control means for exerting a biasing force thereon so that said plurality of coacting arms are constantly biased toward said first position.

3. The soap holder of claim 2 wherein said biasing means comprises at least one spring arranged on said phase control means for movement from a first expanded position at which said plurality of coacting arms assume a nonengaged configuration to a further expanded position at which said plurality of coacting arms assume an engaged configuration upon insertion of a bar of soap therebetween.

4. The soap holder of claim 1 wherein said phase control means comprises a first sector gear and a second sector gear, each of said first and second sector gears having teeth thereon and being operatively associated with each other so that said teeth of said first sector gear mesh with said teeth of said second sector gear during synchronized rotatable movement of said first and second sector gears.

5. A soap holder comprising:

a housing having an interior and an exterior;

a plurality of bearings fixed in said housing at a predetermined spaced distance from each other;

a plurality of shafts rotatably mounted within corresponding ones of said plurality of bearings and extending from said interior to said exterior of said housing;

a plurality of coacting arms mounted on associated ones of said plurality of shafts for rotatable movement therewith, said plurality of coacting arms being disposed for synchronous movement with each other and with respective ones of said plurality of shafts from a first position at which said plurality of coacting arms are normally biased to a nonengaged configuration and a second position at which said plurality of coacting arms are biased to an engaged configuration upon insertion of a bar of soap therebetween; and phase control means operatively connected to send plurality of shafts and being mounted at said interior of said housing for synchronizing rotatable movement of said plurality of coacting arms.

6. The soap holder of claim 5 further comprising biasing means operatively connected to said phase control means for exerting a biasing force thereon so that said plurality of coacting arms are constantly biased toward said first position.

7. The soap holder of claim 6 wherein said biasing means comprises at least one spring arranged on said phase control means for movement from a first expanded position at which said plurality of coacting arms assume a nonengaged configuration to a further expanded position at which said plurality of coacting arms assume an engaged configuration upon insertion of a bar of soap therebetween.

8. The soap holder of claim 5 wherein said phase control means comprises a first sector gear and a second sector gear, each of said first and second sector gears having teeth thereon and being operatively associated with each other so that said teeth of said first sector gear mesh with said teeth of said second sector gear during synchronized rotatable movement of said first and second sector gears.

9. The soap holder of claim 5 wherein said plurality of shafts include a first shaft and a second shaft, and wherein said plurality of bearings include a first bearing and a second bearing spaced from each other within said housing and being disposed to receive respective ones of said first and second shafts therein.

10. The soap holder of claim 9 wherein said plurality of coacting arms comprises a first coacting arm and a second coacting arm, each of said first and second coacting arms having a first end mounted on respective ones of said first and second shafts, and a second end remote from said first end, said second ends being adapted to cooperate so that a bar of soap may be retained therebetween when said first and second coacting arms are arranged in said second position and have thus assumed their engaged configuration.

11. The soap holder of claim 5 wherein said phase control means includes means for receiving said plurality of shafts therein and means for securing said plurality of shafts thereto so that said synchronized rotatable movement of said plurality of coacting arms can be obtained.

12. The soap holder of claim 5 further comprising connecting means for securing the soap holder to a support surface.

13. The soap holder of claim 5 further comprising a support surface adapted to be mounted on a wall, said housing being secured to said support surface.

14. A soap holder comprising:

a housing having an interior and an exterior;

a plurality of bearings fixed in said housing at a predetermined spaced distance from each other;

a plurality of shafts rotatably mounted within corresponding ones of said plurality of bearings and extending from said interior to said exterior of said housing;

a first coacting arm and a second coacting arm mounted on associated ones of said plurality of shafts for rotatable movement therewith, said first and second coacting arms being disposed for synchronous movement with each other and with respective ones of said plurality of shafts from a first position at which said first and second coacting arms are normally biased to a nonengaged configuration and a second position at which said first and second coacting arms are biased to an engaged configuration upon insertion of a bar of soap therebetween, whereby said first and second coacting arms are constantly biased toward said first position;

phase control means operatively connected to said plurality of shafts and being mounted at said interior of said housing for synchronizing rotatable movement of said plurality of coacting arms; said phase control means including means for receiving said plurality of shafts therein and means for securing said plurality of shafts thereto so that said synchronized rotatable movement of said plurality of coacting arms can be obtained; and biasing means operatively connected to said phase control means for exerting a biasing force thereon so that said biasing of said first and second coacting arms toward said first position can be obtained.

15. The soap holder of claim 14 wherein said phase control means comprises a first sector gear and a second sector gear, each of said first and second sector gears having teeth thereon and being operatively associated with each other so that said teeth of said first sector gear are disposed to mesh with said teeth of said second sector gear during synchronized relative rotatable movement of said first and second sector gears.

16. The soap holder of claim 15 wherein said plurality of shafts comprise a first shaft and a second shaft, and wherein said plurality of bearings comprise a first bearing and a second bearing spaced from each other within said housing, said first and second bearings being disposed to receive respective ones of said first and second shafts therein.

17. The soap holder of claim 16 wherein each of said first and second coacting arms comprises a sized and shaped sleeve adapted to be mounted on respective ones of said first and second shafts.

18. The soap holder of claim 17 wherein each of said first and second coacting arms have a first end mounted on respective ones of said first and second shafts, and a second end remote from said first end, each of said second ends being adapted to retain a bar of soap therebetween during mutual cooperation thereof when said first and second coacting arms are arranged in said second position and have thus assumed their engaged configuration.

19. The soap holder of claim 17 wherein said biasing means comprises at least one spring arranged on said first sector gear and said second sector gear and extending therebetween for movement from a first expanded position at which said plurality of coacting arms assume a nonengaged configuration to a further expanded position at which said plurality of coacting arms assume an engaged configuration.

20. The soap holder of claim 17 wherein each of said first and second shafts include a first end connected to respective ones of said sector gears, and a second end remote from said first end.

21. The soap holder of claim 20 further comprising locking means arranged at said second end of said first and second shafts for locking respective ones of said first and second coacting arms to said second end of said first and second shafts.

22. The soap holder of claim 21 wherein each of said first and second shafts comprise a first section having a circular cross-section arranged adjacent said first end and extending linearly therealong toward said second end thereof, and a second section having a generally square cross-section arranged adjacent said second end and extending linearly therealong toward said first end thereof, said first section being disposed for arrangement within said interior of respective ones of said first and second bearings, said second diameter being disposed within said sized and shaped sleeves of respective ones of said first and second shafts, said sized and shaped sleeves of said first and second coacting arms having a generally square cross-section, said locking means comprising the arrangement of said second section of said first and second shafts wherein corresponding ones of said sleeves on said first and second coacting arms.

23. The soap holder of claim 22 wherein said first section of said first and second shafts has a greater diameter than said second section thereof.

24. The soap holder of claim. 23 wherein each of said sector gears includes a bore therein, said bores being adapted to receive respective ones of the circular second sections of the first and second shafts when the soap holder is in assembled position.

25. The soap holder of claim 24 further comprising a first set screw mountable in said first sector gear to fix said first section of said first shaft in said bore thereof, and a second set screw mountable in said second sector gear to fix said second section of said second shaft in said bore thereof.

26. The soap holder of claim 17 further comprising connecting means for securing the soap holder to a support surface.

27. The soap holder of claim 17 further comprising a support surface adapted to be mounted on a wall, said housing being secured to said support surface.

28. The soap holder of claim 14 wherein each of said plurality of shafts have a first end and a second end, said first end of each of said plurality of shafts being integrally connected to respective ones of said first and second coacting arms.

29. The soap holder of claim 28 wherein said second end of each of said plurality of shafts includes a generally square cross-sectional area adapted to be secured to respective ones of said phase control means.

* * * * *